US006309481B1

(12) United States Patent
Koch et al.

(10) Patent No.: US 6,309,481 B1
(45) Date of Patent: Oct. 30, 2001

(54) ALUMINUM CASTING ALLOY

(75) Inventors: Hubert Koch, Rheinfelden; Horst Schramm, Lörrach, both of (DE)

(73) Assignee: Aluminium Rheinfelden, GmbH, Rheinfelden (DE)

( * ) Notice: Subject to any disclaimer, the term of this patent is extended or adjusted under 35 U.S.C. 154(b) by 0 days.

(21) Appl. No.: 09/163,822

(22) Filed: Sep. 30, 1998

(30) Foreign Application Priority Data

Oct. 8, 1997 (EP) ..... 97810756
Mar. 12, 1998 (EP) ..... 98810210

(51) Int. Cl.[7] ..... C22C 21/06
(52) U.S. Cl. ..... 148/440; 420/542; 420/544; 420/546
(58) Field of Search ..... 148/440; 420/542, 420/546, 544

(56) References Cited

U.S. PATENT DOCUMENTS

| | | | | |
|---|---|---|---|---|
| 4,645,544 | | 2/1987 | Baba et al. | 148/415 |
| 4,847,048 | * | 7/1989 | Nishi et al. | 420/547 |
| 5,573,606 | | 11/1996 | Evans et al. | 148/440 |
| 5,578,144 | * | 11/1996 | Satou et al. | 148/415 |
| 5,667,602 | | 9/1997 | Fang et al. | 148/549 |

FOREIGN PATENT DOCUMENTS

| | | | |
|---|---|---|---|
| 85100585 | * | 8/1986 | (CN) . |
| 0745694 | | 12/1996 | (EP) . |
| 63183666 | | 7/1988 | (JP) . |
| 4371545 | * | 12/1992 | (JP) . |
| 5156398 | * | 6/1993 | (JP) . |
| 5263175 | * | 10/1993 | (JP) . |
| 08074012 | * | 3/1996 | (JP) . |
| 8134579 | * | 5/1996 | (JP) . |
| 10130766 | * | 5/1998 | (JP) . |
| 10152762 | * | 6/1998 | (JP) . |

* cited by examiner

*Primary Examiner*—Sikyin Ip
(74) *Attorney, Agent, or Firm*—Bachman & LaPointe, P.C.

(57) ABSTRACT

An aluminium casting alloy contains:

| | |
|---|---|
| 2.0 to 3.5 | w. % magnesium |
| 0.15 to 0.35 | w. % silicon |
| 0.20 to 1.2 | w. % manganese |
| max. 0.40 | w. % iron |
| max. 0.10 | w. % copper |
| max. 0.05 | w. % chromium |
| max. 0.10 | w. % zinc |
| max. 0.003 | w. % beryllium |
| max. 0.20 | w. % titanium |
| max. 0.60 | w. % cobalt |
| max. 0.80 | w. % cerium |

and aluminium as the remainder with further impurities individually max. 0.02 w. %, total max. 0.2 w. %.

The aluminium alloy is particularly suitable for diecasting, thixocasting and thixoforging. A particular application is diecasting for components with high requirements for mechanical properties, as these are present even in the cast state and thus no further heat treatment is required.

12 Claims, No Drawings

ALUMINUM CASTING ALLOY

BACKGROUND OF THE INVENTION

The invention concerns an aluminium casting alloy, in particular an aluminium diecasting alloy.

Diecasting technology has today developed until it is possible to produce castings with high quality standards. The quality of a diecasting depends, however, not only on the machine setting and the process selected but to a great extent also on the chemical composition and grain structure of the casting alloy used. The latter two parameters are known to influence the castability, the supply behaviour (G. Schindelbauer, J. Czikel "Mould Filling Capacity and Volume Deficit of Conventional Aluminium Diecasting Alloys", Casting Research 42, 1990, p. 88/89), the mechanical properties and—what is particularly important in diecasting—the life of the casting tools (L.A. Norstr÷m, B. Klarenf jord, M. Svenson "General Aspects on Wash-out Mechanism in Aluminium Diecasting Dies", 17th International NADCA Diecasting Congress 1993, Cleveland Ohio).

In the past, little attention was paid to the development of alloys suitable in particular for the high quality castings required for diecasting. Most efforts were devoted to the further development of the process technology of the diecasting process. However, designers in the automobile industry in particular are being called upon more and more often to produce weldable components of high ductility in the diecasting process as diecasting is the most cost-favourable production method for large quantities.

The further development of diecasting technology has made it possible today to produce weldable and heat-treatable castings of high quality. This has expanded the area of application for diecastings to safety-relevant components. Usually for such components, AlSiMg alloys are used today as these have good casting properties with low mould wear. In order for the required mechanical properties, in particular a high elongation at yield, to be achieved, the castings must be subjected to heat treatment. This heat treatment is necessary to coalesce the casting phase and thus achieve a tough yield behaviour. Heat treatment normally means solution treatment at temperatures just below the solidus temperature with subsequent quenching in water or another medium to temperatures<100° C. The material treated in this way now has a low limit of elasticity and tensile strength. In order to raise these properties to the required value, artificial ageing is then carried out. This can also be process-related, e.g. by thermal shock on painting or stress-relieving annealing of an entire component group.

As diecastings are cast close to the final dimensions, they usually have a complex geometry with low wall thicknesses. During the solution treatment, and in particular in the quenching process, distortion must be expected which can require retouching, e.g. straightening of the casting, or in the worst case can lead to rejection. Solution treatment also incurs additional costs and the economic benefits of this production method could be substantially improved if alloys were available which fulfilled the required properties without heat treatment.

AlMg alloys are known which are characterized by a high ductility. Such an alloy is disclosed for example in US-A-5 573 606. However, these alloys have the disadvantage of a high mould wear and cause problems on mould removal, which considerably reduces productivity.

SUMMARY OF THE INVENTION

The present invention is therefore based on the task of creating a diecasting alloy with a high elongation at yield with a still acceptable limit of elasticity. The following

DETAILED DESCRIPTION

The present invention is drawn to a diecasting alloy having a high elongation at yield while still maintaining an acceptable limit of elasticity. The following minimal values must be achieved in the casting state:

Elongation (A5):14% Limit of elasticity (Rp 0.2):100 MPa.

The alloy must also have good welding characteristics, a high resistance to corrosion and in particular show no susceptibility to stress corrosion cracking.

In the solution according to the invention, the alloy consists of:

| | |
|---|---|
| 2.0 to 3.5 | w. % magnesium |
| 0.15 to 0.35 | w. % silicon |
| 0.20 to 1.2 | w. % manganese |
| max. 0.40 | w. % iron |
| max. 0.10 | w. % copper |
| max. 0.05 | w. % chromium |
| max. 0.10 | w. % zinc |
| max. 0.003 | w. % beryllium |
| max. 0.20 | w. % titanium |
| max. 0.60 | w. % cobalt |
| max. 0.80 | w. % cerium |

and aluminium as the remainder with further impurities individually max. 0.02 w. %, total max. 0.2 w. %. The degree of purity of the aluminium used to produce the alloy corresponds to a primary aluminium of quality Al 99.8H.

In casting state, this alloy has a well-coalesced α-phase. The eutectic, mainly consisting of $Mg_2Si$ and $Al_6Mn$ phases, is very fine in structure and therefore leads to a highly ductile yielding behaviour. The proportion of manganese prevents adhesion in the mould and guarantees good mould removal. The magnesium content in conjunction with manganese gives the casting a high dimensional strength so that on mould removal little or no distortion can be expected.

Because of the already coalesced α-phase, this alloy can also be used for thixocasting or thixoforging. The α-phase coalesces immediately on remelting to give excellent thixotropic properties. At conventional heating rates, a grain size of<100 μm is produced.

To achieve a high ductility, it is essential that the iron content in the alloy is kept as low as possible. Surprisingly, it has been found that despite the low iron content, the alloy composition according to the invention has no tendency to adhere in the mould. In contrast to the general view that a high iron content prevents adhesion in the mould in all cases, with the alloy type proposed according to the invention it has been found that when the iron content is increased to over 0.4 w. %, an increase in the adhesion tendency is observed.

For the individual alloy elements, the following content ranges are preferred:

| | | |
|---|---|---|
| Magnesium | 2.5 to 3.3 | w. % in particular 2.6 to 3.3 w. % |
| Silicon | 0.20 to 0.30 | w. % |
| Manganese | 0.40 to 1.2 | w. % in particular 0.50 to 1.0 w. % |
| Iron | max. 0.30 | w. % in particular max. 0.15 w. %. |

The tendency of the casting to adhere to the mould can be further reduced drastically and the mould removal behaviour improved substantially if manganese is replaced partly by cobalt and/or cerium. The alloy preferably therefore contains 0.10 to 0.60 w. %, in particular 0.30 to 0.60 w. % cobalt and/or 0.05 to 0.80 w. %, in particular up to 0.50 w. % cerium. An optimum effect is achieved if the total of the contents of cobalt, cerium and manganese in the alloy is at least 0.80 w. % and the alloy contains at least 0.50 w. % manganese.

The aluminium casting alloy according to the invention is particularly suitable for thixocasting or thixoforging.

Although the aluminium casting alloy according to the invention is intended in particular for processing in the diecasting process, it can evidently also be cast with other processes, e.g.:

sand casting gravity diecasting low pressure casting thixocasting/thixoforging squeeze casting.

The greatest advantages however arise in casting processes which entail high cooling rates, such as for example diecasting.

Further advantages, features and details of the aluminium casting alloy according to the invention and their excellent properties are explained in the description below of preferred design variants.

EXAMPLES

On a diecasting machine with 400 t closing force, a pot of wall thickness 3 mm and dimensions 120×120×60 mm was cast from four different alloys. Specimen bars were taken from the side sections for tensile tests, and the mechanical properties in the cast state measured on these. The results are shown in the table below. Here RpO.2 is the limit of elasticity, Rm the tensile strength and A5 the elongation at yield. The measurement values given are averages of 10 individual measurements. The alloys were melted on the base primary aluminium of quality Al 99.8 H.

The tests show that the required minimum values for limit of elasticity and elongation at yield are achieved by the aluminium casting alloy according to the invention in the casting state.

The alloy has good welding properties, an excellent casting behaviour, practically negligible adhesion tendency and can be removed cleanly from the mould.

| | | Alloy 1 | Alloy 2 | Alloy 3 | Alloy 4 |
|---|---|---|---|---|---|
| Si | (w. %) | 0.25 | 0.25 | 0.25 | 0.23 |
| Fe | (w. %) | 0.25 | 0.10 | 0.07 | 0.10 |
| Mn | (w. %) | 0.80 | 0.80 | 0.77 | 0.78 |
| Mg | (w. %) | 2.90 | 2.40 | 2.34 | 2.35 |
| Ce | (w. %) | — | 0.40 | 0.20 | — |
| Co | (w. %) | 0.30 | — | — | — |

-continued

| | | Alloy 1 | Alloy 2 | Alloy 3 | Alloy 4 |
|---|---|---|---|---|---|
| Rp 0.2 | ($N/mm^2$) | 130 | 107 | 120 | 129 |
| Rm | ($N/mm^2$) | 250 | 219 | 205 | 218 |
| A5 | (%) | 19.0 | 20.9 | 16.3 | 20.0 |

What is claimed is:

1. Aluminum casting alloy consisting essentially of:

| | |
|---|---|
| 2.0 to 3.5 | w. % magnesium |
| 0.15 to 0.35 | w. % silicon |
| 0.20 to 1.2 | w. % manganese |
| max. 0.40 | w. % iron |
| max. 0.10 | w. % copper |
| max. 0.05 | w. % chromium |
| max. 0.10 | w. % zinc |
| max. 0.003 | w. % beryllium |
| max. 0.20 | w. % titanium |
| and at least one of | |
| 0.10 to 0.60 | w. % cobalt and |
| 0.05 to 0.80 | w. % cerium |

and aluminum as the remainder with further impurities individually max. 0.02 w. %, total max. 0.2 w. %.

2. Aluminum casting alloy according to claim 1, wherein the alloy contains 2.5 to 3.3 w. % magnesium.

3. Aluminum casting alloy according to claim 1, wherein the alloy contains 0.20 to 0.30 w. % silicon.

4. Aluminum casting alloy according to claim 1, wherein the alloy contains 0.40 to 1.2 w. % manganese.

5. Aluminum casting alloy according to claim 1, wherein the alloy contains max. 0.30 w. % iron.

6. Aluminum casting alloy according to claim 1, wherein the alloy contains 0.30 to 0.60 w. % cobalt.

7. Aluminum casting alloy according to claim 1, wherein the alloy contains 0.10 to 0.50 w. % cerium.

8. Aluminum casting alloy according to claim 1, wherein the total content of cobalt, cerium and manganese in the alloy is min. 0.80 w. % and the alloy contains min. 0.50 w. % manganese.

9. Aluminum casting alloy according to claim 1, wherein the alloy, as a diecasting alloy in the casting state, has a limit of elasticity (Rp0.2) of min. 100 MPa and an elongation at yield (A5) of min. 14%.

10. Aluminum casting alloy according to claim 1, wherein the alloy contains 2.6 to 3.3 w. % magnesium.

11. Aluminum casting alloy according to claim 1, wherein the alloy contains 0.50 to 1.0 w. % manganese.

12. Aluminum casting alloy according to claim 1, wherein the alloy contains max. 0.15 w. % iron.

* * * * *